US008654020B2

(12) United States Patent
Kim et al.

(10) Patent No.: US 8,654,020 B2
(45) Date of Patent: Feb. 18, 2014

(54) ANTENNA HAVING CAPACITIVE ELEMENT

(75) Inventors: Hyeong-dong Kim, Seoul (KR); Sin-hyung Jeon, Seoul (KR); Hyeng-cheul Choi, Seoul (KR)

(73) Assignee: Radina Co., Ltd, Seoul (KR)

( * ) Notice: Subject to any disclaimer, the term of this patent is extended or adjusted under 35 U.S.C. 154(b) by 530 days.

(21) Appl. No.: 12/997,992

(22) PCT Filed: Aug. 25, 2010

(86) PCT No.: PCT/KR2010/005675

§ 371 (c)(1), (2), (4) Date: Dec. 14, 2010

(87) PCT Pub. No.: WO2012/026635

PCT Pub. Date: Mar. 1, 2012

(65) Prior Publication Data

US 2012/0050121 A1 Mar. 1, 2012

(51) Int. Cl.
*H01Q 9/00* (2006.01)

(52) U.S. Cl.
USPC ..... 343/745; 343/700 MS

(58) Field of Classification Search
USPC ..... 343/702, 700 MS, 846, 745
See application file for complete search history.

(56) References Cited

U.S. PATENT DOCUMENTS 5,917,450 A * 6/1999 Tsunekawa et al. ... 343/700 MS
6,538,604 B1 * 3/2003 Isohatala et al. ..... 343/700 MS
6,882,317 B2 * 4/2005 Koskiniemi et al. ... 343/700 MS
2001/0035843 A1 11/2001 Boyle
2004/0070537 A1 4/2004 Kadambi et al.
2007/0200766 A1 8/2007 McKinzie et al.
2010/0065647 A1 * 3/2010 Ritamaki et al. ..... 235/492

FOREIGN PATENT DOCUMENTS

JP 05-259724 A 10/1993
JP 2005-210568 A 8/2005
KR 10-2003-0066779 A 8/2003
KR 10-2006-0065638 A 6/2006
KR 10-2009-0076839 A 7/2009

OTHER PUBLICATIONS

International Search Report in International Application No. PCT/KR2010/005675, dated Apr. 27, 2011.

* cited by examiner

*Primary Examiner* — Tan Ho
(74) *Attorney, Agent, or Firm* — Park, Kim & Suh, LLC

(57) ABSTRACT

An antenna having a capacitive element is disclosed. Herein, the antenna is configured of a radiator, a ground plane being spaced apart to a predetermined distance from the radiator, a ground pin electrically connected to the radiator and the ground plane, a capacitive element located between the radiator and the ground plane, a first branch arm electrically connecting the capacitive element and the radiator, and a second branch arm electrically connecting the capacitive element and the ground plane. Thus, multiple band and broad band characteristics can be realized by the simple structure of the antenna.

10 Claims, 4 Drawing Sheets

(a)

(b)

(C)

ANTENNA HAVING CAPACITIVE ELEMENT

CROSS REFERENCE TO PRIOR APPLICATIONS

This application is a National Stage Patent Application of PCT International Patent Application No. PCT/KR2010/005675 (filed on Aug. 25, 2010) under 35 U.S.C. §371, which are all hereby incorporated by reference in their entirety.

BACKGROUND OF THE INVENTION

1. Field of the Invention

The present invention relates to an antenna and, more particularly, to an antenna having multiple band and broad band characteristics by being provided with a capacitive element.

2. Related Art Technology

Generally, as an antenna becomes more compact in size, various problems may occur, such as radiation efficiency of the antenna being degraded, bandwidth becoming narrower, and antenna gain being reduced. However, as mobile telecommunications devices are being more developed and evolved, the necessity of high-performance antenna being more compact in size and having a wider bandwidth is also growing accordingly.

In earlier mobile telecommunications device, either a ¼ wavelength monopole antenna was used as an internal antenna, or a helical external antenna was mainly used. However, such antennae cause an inconvenience in portability for the users and are also disadvantageous in radiation efficiency and robustness.

In order to resolve such shortcomings, active research was carried out on internal antennae and, most particularly, research was carried out most vigorously on inverse-F antennae. The inverse-F antenna is fabricated by simple fabrication process and is configured to have a flat surface structure, thereby being easily applied as an internal antenna. Accordingly, the inverse-F antenna is now most widely used as the internal antenna of the current mobile telecommunications devices.

FIG. 1 illustrates a structure of a related art inverse-F antenna. Referring to FIG. 1, the related art inverse-F antenna includes a radiator (100), a ground plane (102), a ground pin (104), and a feeding pin (106).

The radiator (100) is generally configured to have the form of a flat plate. Herein, the radiator (100) maintains a predetermined distance from the ground plane, and has a function of transmitting and receiving RF signals. Also, the feeding pin (106) is electrically connected to a feeding line, and a signal is fed to the radiator (100) through the feeding pin (106).

When using the above-described related art antenna, the antenna is operated as an antenna having a single band, thereby having the problem of not being capable to have the characteristics of a broad band.

SUMMARY OF THE INVENTION

Object of the Invention

An object of the present invention is to provide an antenna that has multiple band characteristics, while having a simple structure. Additionally, another object of the present invention is to provide an antenna having broad band characteristics by using such multiple band characteristics.

Technical Solutions of the Invention

The present invention is configured of a radiator, a ground plane being spaced apart to a predetermined distance from the radiator and having a ground potential, a ground pin electrically connected to the radiator and the ground plane, a capacitive element located between the radiator and the ground plane, a first branch arm electrically connecting the capacitive element and the radiator, and a second branch arm electrically connecting the capacitive element and the ground plane.

Also, the present invention is configured of a first current loop configured of a ground plane, a ground pin, a radiation plate, and a feeding pin, each being electrically interconnected to one another, a second current loop configured of the ground plane, a first branch arm, a capacitive element, a second branch arm, the radiation plate, and the ground pin, each being electrically interconnected to one another, and a third current loop configured of the ground plane, the first branch arm, the capacitive element, the second branch arm, the radiation plate, and the feeding pin, each being electrically interconnected to one another.

Effect of the Invention

The antenna according to the present invention has the effect of having multiple band and broad band characteristics, while being configured to have a simple structure.

DETAILED DESCRIPTION OF THE INVENTION

Hereinafter, exemplary embodiments having the widely used inverse-F antenna applied therein will now be described in detail.

Figure 1:
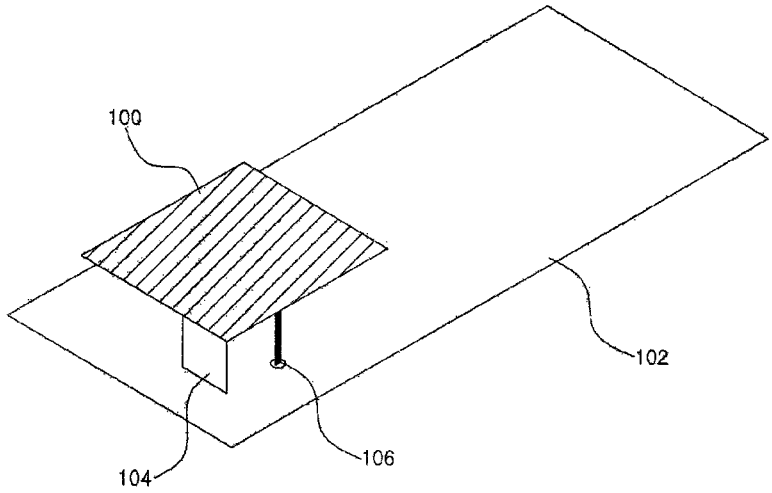
FIG. 1 Prior Art
FIG. 1 illustrates a structure of a related art inverse-F antenna.
Figure 2:
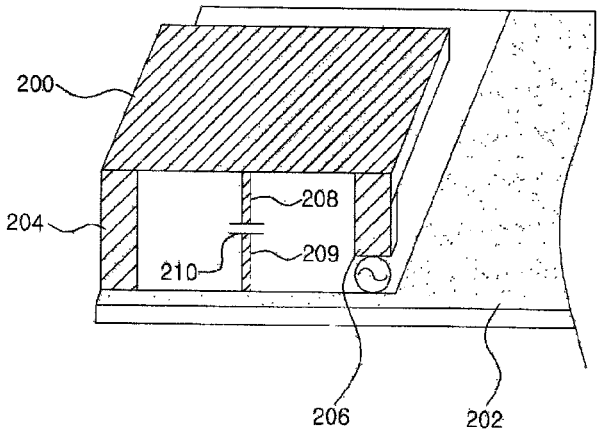
FIG. 2 illustrates a structure of an antenna according to a first embodiment of the present invention.

FIG. 2 illustrates a structure of an antenna according to a first embodiment of the present invention.

Referring to FIG. 2, the antenna according to the present invention is configured to include a radiator (200), a ground plane (202), a ground pin (204), a feeding pin (206), a first branch arm (208), a second branch arm (209), and a branch capacitor (210).

The radiator (200) performs the functions of radiating the fed RF signals and receiving the RF signals. A frequency of the RF signal that is being radiated or received is decided based upon the form (or shape) and size of the radiator (200).

Although the radiator (200) is shown to have a flat surface structure in FIG. 2, the shape (or structure) of the radiator will not be limited only to this. And, various types of radiators having diverse forms, such as line forms, meander forms, may be used.

Although FIG. 2 shows a case wherein the radiator (200) is formed in parallel above the ground plane so as to have a predetermined height. However, the position of the radiator (200) may be realized differently than as shown in FIG. 2, while maintaining the connection between the ground pin (204) and the feeding pin (206).

The ground plane (202) is in an electrically grounded state, and, when being installed in a mobile telecommunication user equipment, a ground surface of a user equipment substrate may be used as the ground plane, and a separate ground plane may also be provided.

The ground pin (204) is configured to have one end connected to the ground plane (202) and another end connected to the radiator (200). The ground pin (204) corresponds to a characteristic element of the inverse-F antenna, and, as compared to the general monopole antenna, resonant frequency may be reduced by the ground pin (204), and a convenient impedance matching may be realized by the ground pin (204).

The feeding pin (206) is configured to have one end electrically connected to a feeding line, and another end of the feeding pin (206) is connected to the radiator (200), so as to feed RF signals to the radiator (200). Diverse forms of feeding line, such as a coaxial cable, a microstrip line, and so on, may be used as the feeding line that is connected to the feeding pin (206).

The first branch arm (208) is connected from the radiator (200), and the second branch arm (209) is connected from the ground plane (202). The first branch arm (208) and the second branch arm (209) are each configured of a conductive material, and the branch capacitor (210) is connected between the first branch arm (208) and the second branch arm (209). Herein, a chip capacitor, and so on, may be used as the branch capacitor (210), and the branch capacitor (210) may correspond to a capacitor of which capacitance is variable. Meanwhile, although it is preferable that the ground pin (204), the feeding pin (206), and the branch capacitor (210) are formed to have a same flat surface, the present invention will not be limited only to this structure.

Additionally, although the antenna according to the first embodiment of the present invention is configured in the order of the ground pin (204), the branch capacitor (210), and the feeding pin (206), starting from the left, the branch capacitor (210) may be formed on the left side of the feeding pin (206). Also, the branch capacitor (210) may also be formed on the right side of the feeding pin (206).

As described above, if a current (or electric current) loop including a capacitor is added to the related art antenna, bands respective to 2 current loops including a capacitor may be added, in addition to the band respective to the related art current loop. Thus, the antenna may be given the multiple band characteristics. Also, by varying the capacitance of the capacitor, the resonance band may also be varied.

Figure 3:
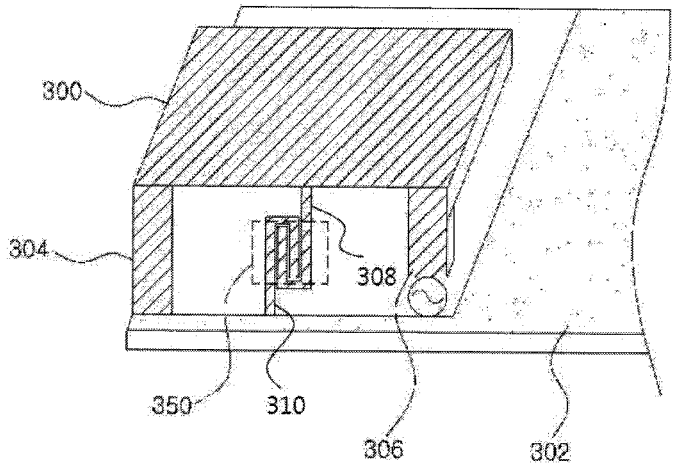
FIG. 3 illustrates a structure of an antenna according to a second embodiment of the present invention.

FIG. 3 illustrates a structure of an antenna according to a second embodiment of the present invention.

Referring to FIG. 3, the antenna according to the second embodiment of the present invention is configured to include a radiator (300), a ground plane (302), a ground pin (304), a feeding pin (306), a first branch arm (308), a second branch arm (310), and a structural capacitor (350).

Unlike in the first embodiment, a separate capacitor is not used in the second embodiment. Instead, by using the structural capacitor (350), which structurally configures a capacitor by using an extension line of the first branch arm (308) and the second branch arm (310), a current loop for a resonance is configured.

More specifically, the first branch arm (308) is connected to the radiator (300) so as to be extended towards the ground plane (302), and the second branch arm (310) is connected to the ground plane (302) so as to be extended towards the radiator (300). The first branch arm (308) and the second branch arm (310) have the structure of being spaced apart from one another to a predetermined distance at predetermined portions, so as to realize electromagnetic coupling.

The capacitance of the structural capacitor (350) may be adjusted by using the size of the structural capacitor (350) and a gap (or space) of the first branch arm (308) and the second branch arm (310) from the structural capacitor (350). If a higher capacitance level is required, a dielectric may also be provided between the first branch arm (308) and the second branch arm (310).

Moreover, in addition to the structure shown in FIG. 3, the structural capacitor (350) may also be embodiment in diverse forms by using the extension line of the first branch arm (308) and the second branch arm (310).

Additionally, although the antenna according to the second embodiment of the present invention is configured in the order of the ground pin (304), the branch capacitor (209), and the feeding pin (206), starting from the left, the structural capacitor (350) may be formed on the left side of the feeding pin (304). Also, the structural capacitor (350) may also be formed on the right side of the feeding pin (306).

Figure 4:
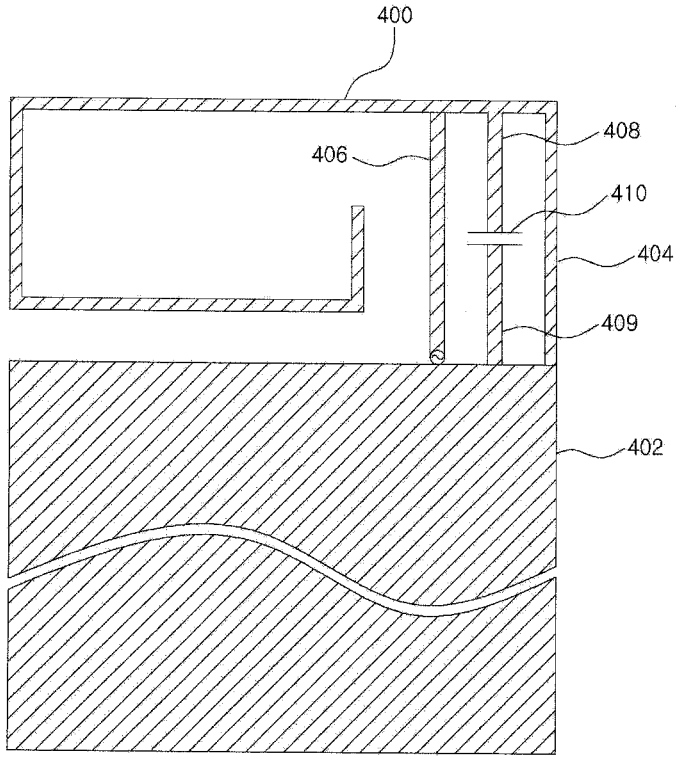
FIG. 4 illustrates a structure of an antenna according to a third embodiment of the present invention.

FIG. 4 illustrates a structure of an antenna according to a third embodiment of the present invention.

Referring to FIG. 4, the antenna according to the third embodiment of the present invention is configured to include a radiator (400), a ground plane (402), a ground pin (404), a feeding pin (406), a first branch arm (408), a second branch arm (409), and a structural capacitor (410).

Unlike the first embodiment and the second embodiment, the third embodiment of the present invention relates to an antenna configured of a radiator having the form of the letter L and not of a radiator (400) having the form of a flat substrate.

More specifically, as shown in the third embodiment, even if the form of the radiator is not the form of a flat substrate, and even if the radiator is formed in the shape of the letter L or in a wide range of other shapes, by using the branch capacitor (410), an antenna having the multiple band characteristics may be realized.

Figure 5:
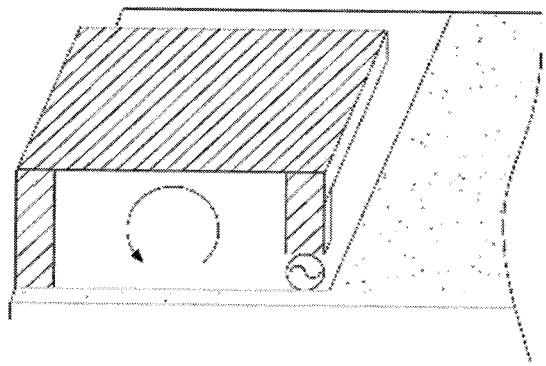
FIG. 5 illustrates a descriptive view for describing a principle showing different band characteristics of the related art antenna and the antenna according to the present invention.
Figure 5:
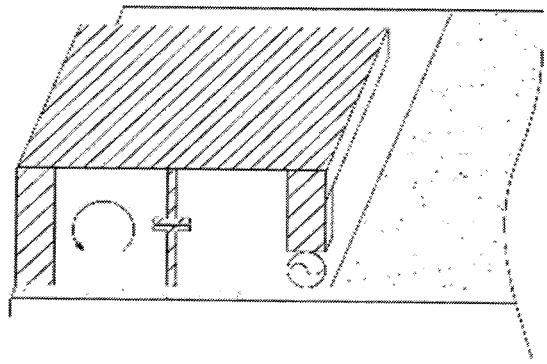
Figure 5:
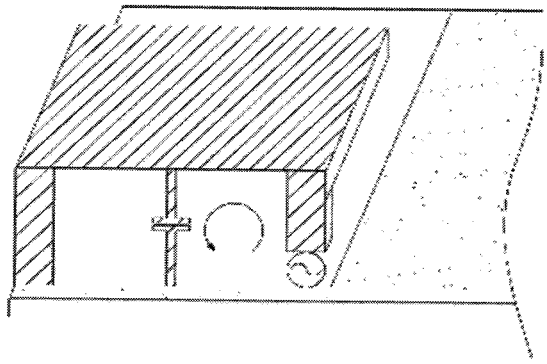

FIG. 5 illustrates a descriptive view for describing a principle showing different band characteristics of the related art antenna and the antenna according to the present invention.

(a) of FIG. 5 illustrates a current loop being formed in the related art antenna. As shown in (a) of FIG. 5, a low frequency current loop is formed in accordance with the feeding pin, the radiator, and the ground pin, and a first band is formed accordingly.

(b) and (c) of FIG. 5 respectively illustrate a current loop being formed in the antenna according to the present invention. As shown in (b) and (c) of FIG. 5, in addition to a first low frequency current loop formed in accordance with the feeding pin, the radiator, by forming a second middle frequency current loop in accordance with the ground pin, a radiation plate, and the branch capacitor, and by forming a third high frequency current loop in accordance with the feeding pin, the radiation plate, and the branch capacitor, a different band may be formed for each loop. More specifically, in addition to the first band respective to the first current loop, additional bands respective to the second and third current loops may be formed. Thus, an antenna having the multiple band characteristics may be realized.

A resonance band, which is formed by the second middle frequency current loop, is decided based upon a capacitance value of the branch capacitor. Generally, if the capacitance of the branch capacitor has a higher capacitance value, the resonance band is formed in a lower band. And, if the capacitance of the branch capacitor has a lower capacitance value, the resonance band is formed in a higher band.

Figure 6:
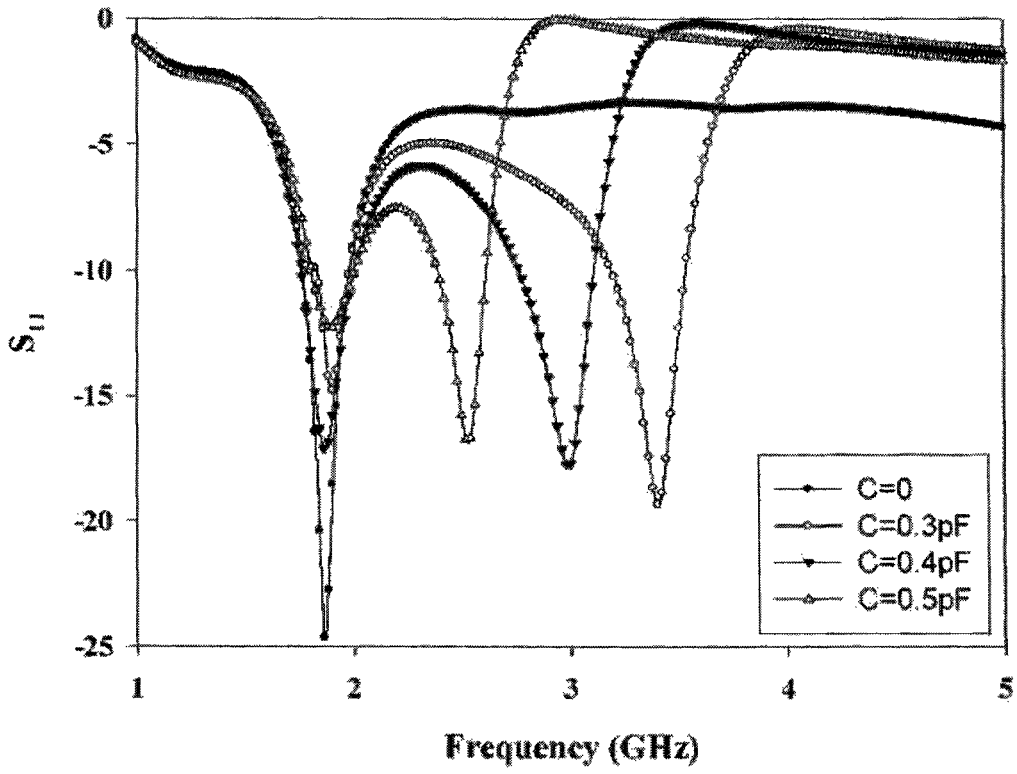
FIG. 6 illustrates a descriptive view showing multiple band characteristics of the antenna according to the present invention.

FIG. 6 illustrates a descriptive view showing multiple band characteristics of the antenna according to the present invention. FIG. 6 shows a change in an S11 parameter according to frequencies with respect to a capacitance value of the branch capacitor.

FIG. 6 shows a case wherein the capacitance value of the branch capacitor is 0.3 pF, 0.4 pF, and 0.5 pF. In FIG. 6, it is shown that an additional band is formed near 2.55 GHz by middle frequency and high frequency current loop of the feeding structure as well as radiator resonance band of 1.8 GHz by low frequency current loop.

Moreover, when the capacitance of the branch capacitor is decreased to 0.4 pF and 0.3 pF, it can be known that the resonance band increases. More specifically, in case the capacitance is 0.4 pF, a band is formed at approximately 3.GHz, and in case the capacitance is 0.3 pF, a band is formed at approximately 3.5 GHz.

Therefore, by adjusting the capacitance so that the resonant frequency (second middle frequency band) of the feeding structure can be formed within a range close to the frequency band (first low frequency band) of the radiator, an antenna having a broad band characteristic may eventually be realized.

By adjusting the capacitance of the branch capacitor, the band frequency related to the feeding structure may be varied. However, in this case, the basic resonance band formed by the (a) low frequency current loop is not varied in the inverse-F antenna.

Therefore, by adjusting the capacitance of the branch capacitor, while maintaining the basic resonant frequency band, the present invention is advantageous in that multiple resonance characteristics and broad band characteristics of various bands can be realized, and that multiple band and broad band characteristics can be realized by the simple structure of the antenna.

The invention claimed is:

1. An antenna having a capacitive element, comprising:

a first current loop configured of a ground plate, a ground pin, a radiation structure, and a feeding pin, each being electrically interconnected to one another;

a second current loop configured of the ground plate, a first branch arm, the capacitive element, a second branch arm, the radiation structure, and the ground pin, each being electrically interconnected to one another;

and a third current loop configured of the ground plate, the first branch arm, the capacitive element, the second branch arm, the radiation structure, and the feeding pin, each being electrically interconnected to one another.

2. The antenna of claim 1, wherein the capacitive element corresponds to a lumped element.

3. The antenna of claim 2, wherein the capacitive element corresponds to a capacitor of which capacitance is variable.

4. The antenna of claim 1, wherein the capacitive element corresponds to a structural capacitor being formed by an electric coupling of the first branch arm and the second branch arm.

5. The antenna of claim 1, wherein a first loop corresponds to a low frequency loop, wherein a second loop corresponds to a middle frequency loop, and wherein a third loop corresponds to a high frequency loop.

6. An antenna comprising:

a first current loop including a radiation structure, a ground pin connected to the radiation structure, and a ground plate connected to the ground pin;

a second current loop including the ground plate, a first branch arm connected to the ground plate, a capacitive element connected to the first branch arm, a second branch arm connected to the capacitive element, the radiation structure connected to the second branch arm, and the ground pin; and a third current loop including the radiation structure, the second branch arm, the capacitive element, the first branch arm, and the ground plate.

7. The antenna of claim 6, wherein the capacitive element is a lumped element.

8. The antenna of claim 6, wherein the capacitive element is a capacitor having a variable capacitance.

9. The antenna of claim 6, wherein the capacitive element is a structural capacitor formed by an electrical coupling of the first and second branch arms.

10. The antenna of claim 6, wherein the first current loop is a low frequency loop, the second current loop is a middle frequency loop, and the third current loop is a high frequency loop.

* * * * *